US005771656A

United States Patent [19]

Amoretti

[11] Patent Number: 5,771,656

[45] Date of Patent: Jun. 30, 1998

[54] FIBERBOARD DOORS

[75] Inventor: Ronald J. Amoretti, San Antonio, Tex.

[73] Assignee: Connoisseur Doors, San Antonio, Tex.

[21] Appl. No.: 659,189

[22] Filed: Jun. 5, 1996

[51] Int. Cl.[6] ..... E06B 3/74

[52] U.S. Cl. ..... 52/745.14; 52/745.19; 52/784.1; 52/455; 156/304.5; 144/344

[58] Field of Search ..... 52/455–457, 784.1, 52/785.1, 745.15, 745.19; 156/304.5; 144/344

[56] References Cited

U.S. PATENT DOCUMENTS

| | | | |
|---|---|---|---|
| 563,779 | 7/1896 | Mathewson | 52/455 |
| 570,391 | 10/1896 | Fox | 52/455 X |
| 579,696 | 3/1897 | Carter | 52/455 |
| 2,825,099 | 3/1958 | Simmons | 52/455 |
| 3,121,263 | 2/1964 | Binner | 52/455 |
| 4,104,828 | 8/1978 | Naslund et al. | 49/399 |
| 4,597,928 | 7/1986 | Terentiev et al. | 264/87 |
| 5,020,292 | 6/1991 | Strom et al. | 52/309.9 |
| 5,422,155 | 6/1995 | Spence, Jr. | 428/76 |

FOREIGN PATENT DOCUMENTS 755232 8/1975 South Africa .

OTHER PUBLICATIONS

Connoisseur Doors, Inc., "Works of Art$_2$ . . . entries to enchance your home".

Connoisseur Doors, Inc., "Works of Art" Entry Ideas.

Connoisseur Doors, Inc., "Simply Superior".

Lotus Amoretti Doors, "A Touch of Elegance".

Lotus Amoretti Doors, "Lotus Doors and Windows".

Phoenix Moulding & Door Supply, New–Tech Doors.

Supawood Doors.

Tru Stile Doors, LLC., TruStile MDF Doors.

Connoisseur Doors, Inc., "Works of Art".

Product sample and photographs of said sample.

*Primary Examiner*—Robert Canfield
*Attorney, Agent, or Firm*—Arnold, White & Durkee

[57] ABSTRACT

Fiberboard doors and methods for constructing the same are shown. Doors are constructed by assembling fiberboard stiles and fiberboard rails to form door-halves and then by bringing the door-halves together. The doors may be constructed to have one or more panels, mullions and intermediate rails. The doors may also be of standard or decorative design, and include panels made of glass or other materials.

14 Claims, 5 Drawing Sheets

FIBERBOARD DOORS

BACKGROUND OF THE INVENTION

1. Field of the Invention

This invention relates generally to doors made from fiberboard and methods of their manufacture. This invention more particularly concerns a door which comprises a two fiberboard door-halves assembled together. Each door-half comprises an assembly of frame members including stiles and rails which are joined by joints especially designed for rigidity and strength.

2. Description of the Related Art

For many years, solid wood doors were used exclusively in the home-building industry. However, due to the increasing cost of lumber, demand has risen for doors made of alternative materials. Most recently, interest in suitable alternatives to solid wood doors has intensified due to growing environmental concern over the destruction of forests.

One common alternative to solid wood door construction that has been available for many years is the "hollow core" door design. Using this design, doors are constructed of a thin "shell" of wood or other suitable material around a hollow core. Although the hollow core door design offers the advantage of low cost and lightweight construction, it also lacks in rigidity and structural integrity. These doors are easily punctured or otherwise compromised. In addition, hollow core doors do a poor job of reproducing or imitating the "solid feel" of a solid wood door. As a result, homeowners may feel that the hollow core door is unacceptable because it may impart an impression of lack of quality. As a hollow core door uses outer surfaces (known as "skins") that are generally only available in certain sizes and designs, the applications for which these doors may be used are limited.

Due to dissatisfaction with the hollow core door design, other methods of door construction have been developed in an attempt to more suitably reproduce the performance of the solid wood door at a lower monetary and environmental cost. One example of such an attempt is a hollow core door design incorporating a filler material in the core of the door. Typical filler materials that have been used with hollow core doors include particle board. Although adding fillers to the hollow core door design may add weight to these doors and somewhat increase the appearance of quality, these doors still offer a limited number of design choices and sizes due to the limited types of hollow door "skins" available.

One alternative material of door construction that has become of increasing interest is medium density fiberboard ("MDF"), a man-made reprocessed wood product. For many years, MDF has been used as a construction material for smaller lightweight items, such as moulding and cabinet doors. However, until recently MDF has not been used as a material in the construction of either interior or exterior doors. This is because a single, door-sized piece of MDF lacks the necessary freestanding rigidity to be a suitable replacement for a solid wood door. When MDF has been used in the construction of doors, it has primarily been as only one component of a multi-component door manufacturing system.

Some methods of door fabrication have combined partial MDF construction with a complex door design in an attempt to make a suitable replacement for the solid wood door. These methods typically employ a solid core slab door together with a large number of different types of materials.

For example, one method utilizes a solid core slab door which has a particle board core, softwood edge banding and a hardboard face veneer as a base for creating a panel door. In the construction technique used to make this type of door, large sections (known as "voids") are cut out of the slab door, leaving a perimeter of the above-mentioned door material. This perimeter of material forms the outside frame of a panel door and serves to delineate any panels therein. MDF panels are then mounted in the cut-out sections of the slab door and secured with MDF moulding that is applied around the outside edges of the cut-out sections. Although the use of MDF panels and moulding serves to increase the "quality feel" of the door by adding weight and some rigidity, the basic structural integrity of the door is still dependent upon the particle board core of the door frame, which may lack the strength of solid wood. The structural integrity of the door is further reduced due to the fact that the MDF panels are supported only by moulding surrounding the edge of the cut-out sections, rendering the door easy to compromise by force. Finally, due to the large number of materials and assembly steps required, this type of door takes a substantial amount of time to construct. Although some variations on this construction technique have attempted to compensate for these shortcomings by supporting the MDF panels with a multi-piece wooden frame rather than a slab door, these wooden-framed MDF doors also suffer to a degree from the same lack of structural integrity described above. In addition, as the wood and MDF materials have different physical properties, these materials react to climatic changes in different ways. This difference may cause MDF panels to separate from wood components of a door, causing unsightly cracking. Consequently, this type of door may be described as basically only a hybrid of a solid core particle board door with cut-out panels.

It has been found that doors may be constructed entirely of MDF by using specific lamination techniques. For example, one method of constructing a MDF door utilizes MDF panels supported "sandwich style" by a three-piece laminated MDF frame. The manufacture of this door is complicated by the presence of three layers of MDF in the door frame. In addition to two MDF frame halves and the interior panels, this method of construction uses strips of MDF "core" material sandwiched between the two MDF frame halves. These strips of core material are required to provide rigidity and to reduce the weight of the door, which tends to be greater than desirable due to the three layer construction of the door. As a result, this method of door construction requires an undesirable amount of machining and gluing of individual parts. Due to the strips of filler material and the relatively thick panel employed, these MDF doors offer rigidity, but at the expense of much more complex manufacturing requirements and a finished weight that may exceed the requirements or capabilities of a particular door installation situation. Disadvantages that result from the excessive weight of these doors include increased transportation costs, difficulty in handling and installation, and increased strain on door hinges. As a result of this excessive weight and the difficulty of manufacture and assembly, the three piece MDF laminate door design has proved to be a less than suitable replacement for the solid wood door in many situations.

SUMMARY OF THE INVENTION

This invention in one respect is a method of making a door in which a first set of essentially fiberboard door-half components including a plurality of vertical frame components and a plurality of horizontal frame components is provided and assembled to form a first door-half, and in which a second set of essentially fiberboard door-half components including a plurality of vertical frame components and a plurality of horizontal frame components is provided and assembled to form a second door-half. The first and second door-halves are then assembled together, i.e., brought into contact with each other.

This invention in another respect is a door having first and second door-halves disposed in contact with each other. The first door-half has a first pair of substantially fiberboard stiles joined to a first pair of substantially fiberboard outer rails including a first bottom rail and a first top rail. The second door-half has a second pair of substantially fiberboard stiles joined to a second pair of substantially fiberboard outer rails including a second bottom rail and a second top rail.

DETAILED DESCRIPTION OF SPECIFIC EMBODIMENTS

Figure 1A:
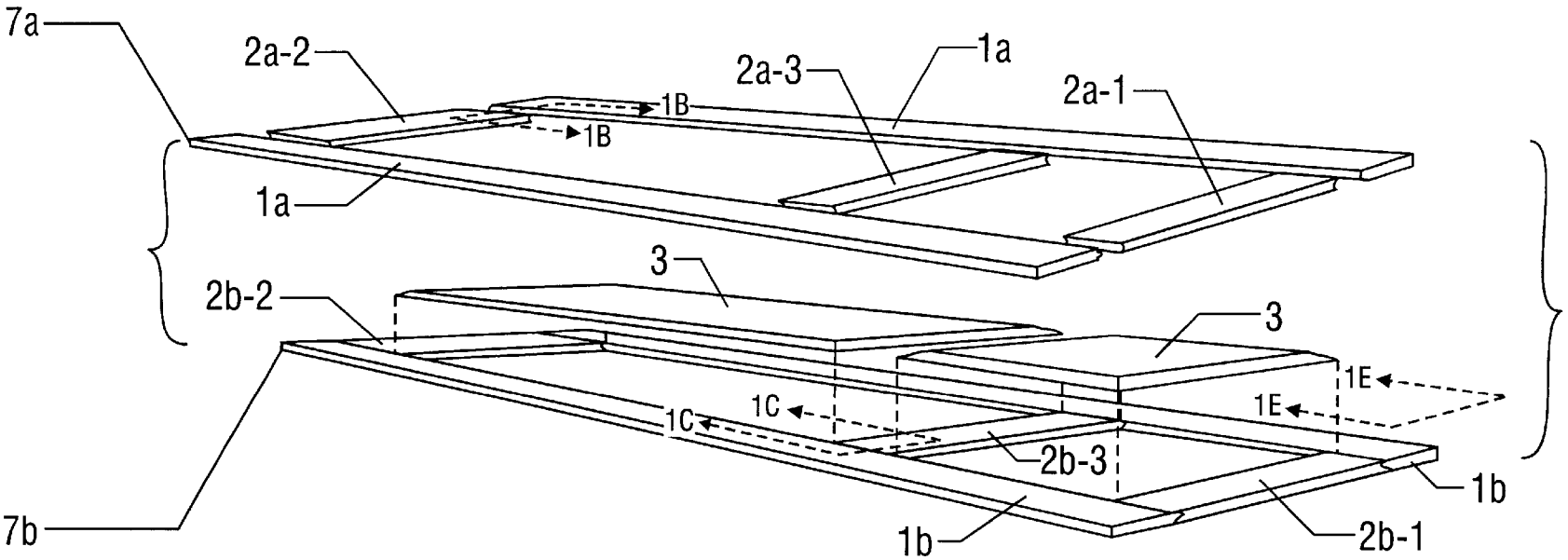
FIG. 1A is an exploded, perspective view which schematically depicts the structural relationship of components of a two-paneled embodiment of this invention ready for assembly.

The door-half components of a two-panel embodiment of the MDF door of this invention are illustrated in FIG. 1A. These components include both vertical frame components and horizontal frame components. The vertical frame components used in the construction of this embodiment include MDF stiles 1*a* and 1*b*. The horizontal frame components include MDF bottom rails 2*a*-1 and 2*b*-1, MDF top rails 2*a*-2 and 2*b*-2 and MDF intermediate "lock" rails 2*a*-3 and 2*b*-3. These door-half components are assembled into door-halves, 7*a* and 7*b*. MDF panels 3 are then positioned and "sandwiched" between door-halves 7*a* and 7*b* during assembly to create a MDF two-panel door 4 as shown in FIG. 2. In order to assemble the various components illustrated in FIG. 1A, joining profiles are formed in the appropriate edges of each door-half component in order to accept a corresponding inverse profile formed in the edge of an adjacent door part. For example, male "sticking" profiles 6 are cut into one side of each stile 1*a* and 1*b* as illustrated in FIG. 1B.

Figure 1D:
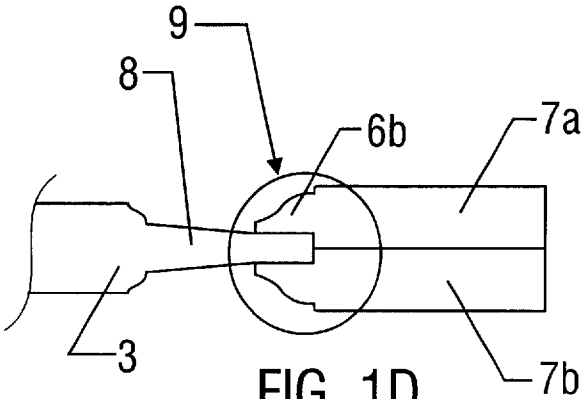
FIG. 1D is a cross-sectional view which depicts the structural relationship of sticking and door panel fielding profiles of an embodiment of this invention after assembly.
Figure 1E:
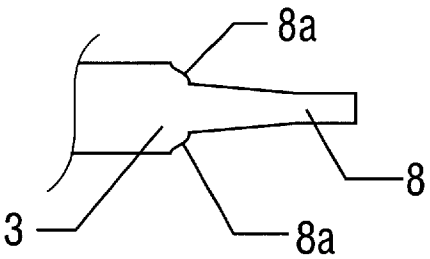
FIG. 1E is a cross-sectional view which depicts a fielding and raised panel profile embodiment of this invention.
Figure 1B:
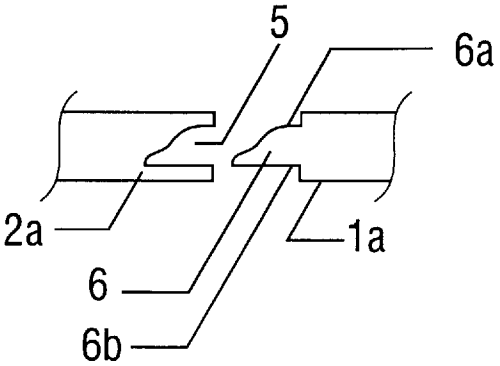
FIG. 1B is an exploded, cross-sectional view which depicts the structural relationship of sticking and coping profiles of an embodiment of this invention ready for assembly.
Figure 1C:
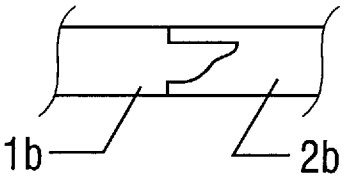
FIG. 1C is a cross-sectional view which depicts the structural relationship of sticking and coping profiles of an embodiment of this invention after assembly.
Figure 2:
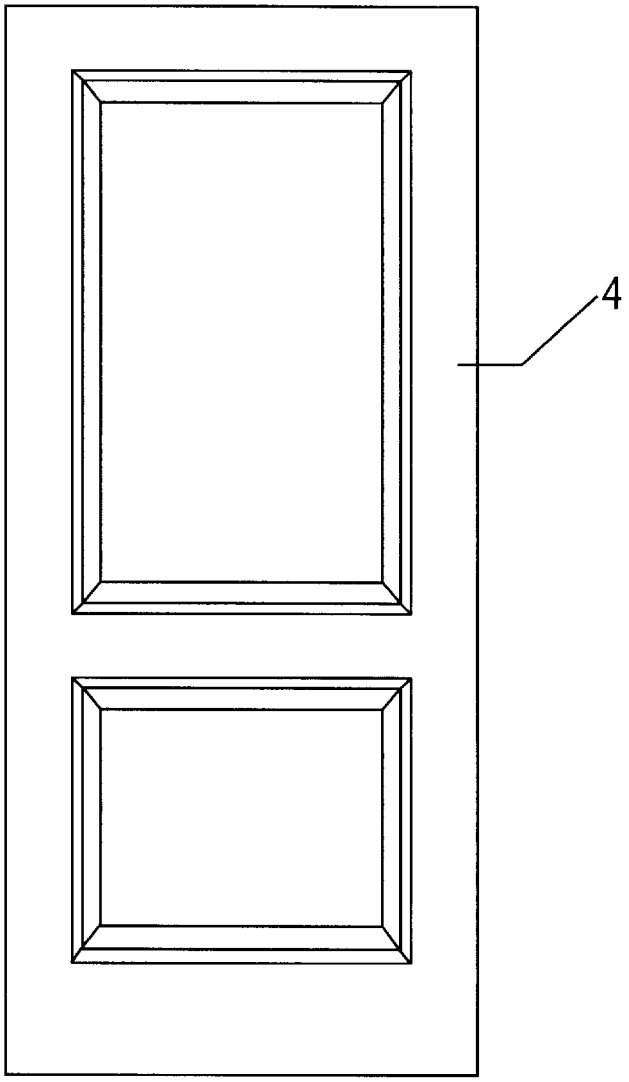
FIG. 2 is an illustration of one embodiment of an assembled two panel door of this invention.

As shown in the section illustrated in FIG. 1B, the sticking profiles are preferably cut to have a decorative or "moulding" edge or surface 6*a* that will eventually be positioned on the outer face of each assembled door, and a squared-off or "rebate" edge or surface 6*b* that will eventually be positioned in the interior of each assembled door. Similarly, female "coping" profiles 5 are cut into each end of each horizontal rail 2*a* and 2*b*, so as to mate "tightly" with the sticking profiles 6 cut into the side of each vertical stile 1*a* and 1*b*, as illustrated in the section illustrated in FIG. IC. By "tight" or "tightly"it is meant that the coping profile is of a shape that is the inverse of the sticking profile shape. Therefore, the sticking profile may be inserted into the coping profile in such a way as to form a joint that has substantially no void space between the two profile shapes. This allows the stiles and rails to be assembled together into a rectangular frame, or "door-half" 7*a* and 7*b*.

In addition to the coping profiles in both ends of each rail, a male sticking profile is cut into the top side of each "bottom" rail 2*a*-1 and 2*b*-1, the bottom side of each "top" rail 2*a*-2 and 2*b*-2, and both sides of each "lock" rail 2*a*-3 and 2*b*-3. These male sticking profiles in the rails function to mate with a fielding profile 8 that is preferably cut around the edge of each panel 3. The profile 8 is preferably beveled or tapered as shown in FIG. 1E. During assembly, each panel 3 is sandwiched between the door-halves 7*a* and 7*b*, so that the fielding profile 8 of the panel 3 fits securely into the recess or mortise 9 created by the rebate edges of the sticking profiles that have been cut into the sides or ends of the components of each door-half 7*a* and 7*b*, as illustrated in FIG. 1D. In addition to the fielding profile 8, each panel in this embodiment may also have a decorative raised panel profile 8*a* cut or otherwise formed adjacent to the fielding profile on each side of the panel, as shown in the section illustrated in FIG. 1E. In one preferred embodiment, doorhalves 7*a* and 7*b* are brought into contact with each other and bonded together with adhesive so that each panel 3 of the assembled door is held securely in place. Where the phrase "brought into contact" is used in the specification in reference to specific door components, it is meant that the specified door components are placed immediately adjacent to each other in such a way that these components either physically touch each other, or are separated from each other by a thin layer of adhesive.

Materials

Using the method of this invention, any suitable type of fiberboard may be used. One preferred type of fiberboard is MDF. Sources of MDF include "MEDITE CORPORATION," "WILLAMETTE INDUSTRIES," and "PLUM CREEK MANUFACTURING", L. P.," among others. In one preferred embodiment, "MEDEX" brand exterior MDF (available from "MEDITE CORPORATION," of Medford, Oreg.) may be used to construct doors of this invention for exterior applications. For interior applications, homogenized double refined MDF (available from "PLUM CREEK MANUFACTURING" of Columbia Falls, Mont.) is preferred. However, the above particular types of fiberboard are not limited to these applications and may be employed in other ways. In addition, other types of fiberboard including, but not limited to, high density fiberboard, water resistant or waterproof fiberboard, and fire resistant or fireproof fiberboard may be employed in the practice of the disclosed method. In the practice of the method of this invention, any size sheet of MDF sufficient to meet the dimensional requirements of the particular door components being constructed may be utilized at the start of the door manufacturing process. In a preferred embodiment, the MDF sheets used have an areal dimension of about 61"×97". Similarly, any thickness of MDF sufficient to meet the requirements of the door component dimensions being constructed may be used. For example, MDF sheets having thicknesses of about 11/16", 7/8" and 1¼" may be employed. In one preferred embodiment of this invention, assembled doors having a standard thickness of about 1⅜" are constructed starting with sheets of MDF having approximate dimensions of 61"×97"×11/16". For standard door thicknesses of about 1¾", MDF sheets of about 61"×97"×7/8" are utilized.

Fabrication of Door-half Components

Figure 3:
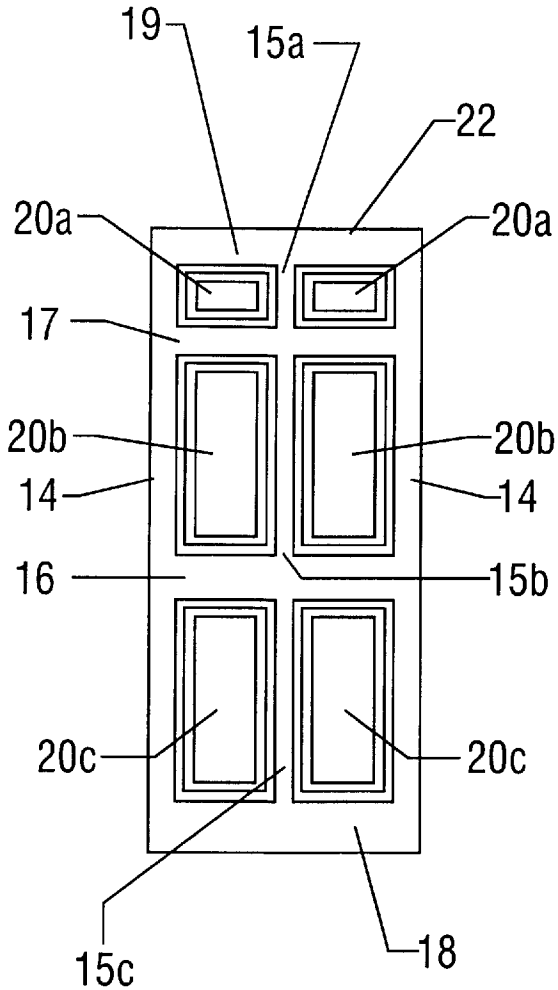
FIG. 3 is an illustration of one embodiment of a six panel door of this invention.

In a preferred embodiment of the method of the present invention shown in FIG. 3, MDF sheets are cut into pieces having proper dimensions to serve as vertical frame components (vertical stiles 14 and vertical "mullions" 15*a*–15*c*, horizontal frame components (intermediate rails 16 and 17, and outer rails 18 and 19), and panels 20*a*–20*c* for the doors of the present invention. The dimensions of these components will depend upon the dimensions and design of the particular MDF door being constructed. Thus, FIG. 3 depicts a six panel MDF door 22 which in an exemplary embodiment may have overall dimensions of 3'×6'8"×1⅜". In this embodiment, the vertical stiles 14 are cut to have dimensions of 5½"×80¼"×11/16", the horizontal rails 16, 17, 18, and 19 are cut to have dimensions of 7½"×25"×11/16" (lock rail), 5½"×25"×11/16",9"×25"×11/16", and 5½"×25"×11/16" respectively, the vertical mullions 15*a*, 15*b*, and 15*c* are cut to have dimensions of 4½"×8"×11/16", 4½"×25"×11/16", and 4½"×25"×11/16" respectively, and the panels 20*a*, 20*b*, and 20*c* are cut to have dimensions of 7⅞"×11 11/16"×7/8",24⅞"×11 11/16"×7/8", and 24⅞"×11 11/16"×7/8" respectively. In this preferred embodiment, the components are cut so as to form a slightly oversized door when assembled (typically by about ¼" in both the width and height directions of a door) to both compensate for material loss during fabrication and to allow a final product of exact dimensions to be cut from the assembled door.

The door components may be cut out of MDF sheets using any suitable type of beam saw or other cutting or sawing means. For example, a panel or circular saw may be used. In a preferred embodiment of the method of this invention, a "CASADEI MODEL LINEA" automatic beam saw is used to simultaneously cut the door-half components and panels from at least two or three sheets of MDF material at one time. In this embodiment, the stile and panel components are ready for profile cutting after having been cut out of the MDF sheet by the automatic beam saw. However, one additional step is used to cut out the shorter rail and mullion pieces. In this step, MDF pieces cut by the automatic beam saw in the above step are further trimmed to shorter lengths required for the rail and mullion pieces using a "WHIRLWIND CUT-OFF SAW."

In a preferred embodiment of the method of the present invention, appropriate joining profiles (including sticking, coping or other suitable profiles) are machined into each door-half component and panel. A male sticking profile is cut into one side of each stile using a "spindle" or "moulding machine" which incorporates a "knife". This machine cuts a sticking profile into one side edge of each vertical stile 14. This sticking profile is comprised of a moulding profile and surface on one side and a rebate profile and surface on the opposite side. The combination of the moulding and rebate profiles is designed to fit tightly (with substantially no void spaces) into a corresponding, but inverse female coping profile that is cut into each end edge of each horizontal rail 16, 17, 18, and 19 to match the male sticking profile. In the practice of this invention, the design and dimensions of the sticking and corresponding coping profiles may be varied to suit door strength requirements and aesthetic taste. In addition, the orientation of the sticking and coping profiles may be changed or reversed. Any suitable shaped joining profile may be used including, but not limited to, square-shaped and round-shape joining profiles, and in the alternative, the door may be constructed without a joining profile.

In a preferred embodiment illustrated in FIG. 1B, the male sticking profile 6 is cut so as to extend about ¾" out from one side edge of each stile. In a separate step, a corresponding, but inverse female coping profile 5 is cut to a depth of about ¾" into each end edge of each rail. In this embodiment, the sticking profile comprises a decorative moulding design 6*a* on one side and a squared-off rebate "notch" 6*b* on the opposite side. Although FIG. 1B shows one preferred embodiment for the moulding edge design, other acceptable designs for the moulding edge include any suitable decorative or nondecorative design that is capable of mating with a corresponding, inverse coping design. In the preferred embodiment illustrated in FIG. 1B, the rebate edge 6*b* of the sticking profile is formed by a square notch cut about ¾" into the edge of the sticking profile positioned opposite the moulding edge 6*a*. In those areas of the assembled door where the vertical stiles do not make contact with a horizontal rail, the fielding profile 8 cut into the panel perimeter edges is designed to fit tightly into the notch of the rebate edge 6*b* of the sticking profile as shown in FIG. 1D. The depth of the rebate can be adjusted in order to provide desired strength and thickness at the stile edges. Any type of shaping machine or machines capable of cutting a moulding and rebate edge may be used to cut a sticking profile into the side edges of the stiles. Examples of acceptable machines include any suitable moulding machine, spindle moulders, routers, etc. In a preferred embodiment of this invention, a "CASOLIN" F-90 shaping machine set with a sticking knife is utilized.

In a preferred embodiment of a six panel door illustrated in FIG. 3, the same sticking profile cut into one side edge of each vertical stile 14 is also cut into the side edges of the horizontal rail and vertical mullion components using the same shaping machine used to cut the profile into the stiles, in this case a "CASOLIN" F-90. The sticking profile is cut into one side edge of the outer rails (known as the "top" 19 and "bottom" 18 rails), and into both side edges of the intermediate rails (an intermediate rail positioned typically about 36" from the bottom of a door by convention is referred to as a "lock" rail 16, all other intermediate rails may be referred to as "cross" rails 17) and mullions 15*a*–15*c*. Although one embodiment having a particular rail and mullion configuration is illustrated in FIG. 3, the number and spacing of rails and/or mullions may be varied as design dictates. For example, an MDF door of the disclosed method may comprise any number of intermediate rails having varying thicknesses and positioned at varying distances from ends of a door. Likewise, an MDF door of the disclosed method may also comprise any number of vertical mullions having varying thicknesses and positioned at varying distances from sides of a door. This results in the fabrication of internal cross and lock rails having a sticking profile cut on both side edges, and top and bottom rails having the sticking profile cut only on the bottom and top side edge of these rails, respectively. Other than in length, the mullions are substantially identical to the cross and lock rails, having a sticking profile cut into both side edges.

In a preferred method embodiment of this invention, the rail and mullion components are cut on a separate scribing machine. In this step, each rail and mullion is trimmed to finished length. At the same time, a female coping profile is cut in each end edge of these components. The depth and design of the female coping profile is cut to correspond and mate in a tight manner with sticking profiles cut into the side edges of each stile and rail. The coping profile cut into the end edges of each rail is designed to mate with the sticking profile cut into the interior side edge of each stile. The coping profile cut into the end edges of each mullion is designed to mate with the sticking profile cut into the interior side edges of each rail (for example, the interior side edge of each outer rail and both side edges of each intermediate rail). In the practice of the method of this invention, any suitable moulding machine or combination of other machines may be employed to trim and profile the ends of the rails and mullions. For example, a single end or double end tenoner, moulding machine, or router may be used. In one preferred embodiment of the method of this invention, a "GABBIANI" M-48 Double End Tenoner machine is used to cut the female coping profiles into the end edges of the rails and mullions. Other suitable means for cutting a coping profile include, for example, a "CASOLIN" F-90 shaping machine set with a coping knife.

In a preferred embodiment, the MDF door panels are trimmed up to ensure that they are square. This step may be accomplished using any suitable saw device. In this preferred embodiment a "CASADEI" beam saw is typically used. The surfaces of the panel edges are then prepared in such a way that they mate with the rebate surfaces of the sticking profiles of the other door components. A bevel profile (known as the "fielding") is cut into the outside perimeter edges of each panel using a "CASOLIN" F-90 spindle moulding machine. In the embodiment illustrated in FIG. 1E, raised panel 8*a* is formed when machining a fielding 8 of about 2¼ inches in depth around the outside perimeter of a panel. Fielding 8 is cut to have sides tapered at a suitable angle such that the edge of the fielding fits tightly into the recessed space created between the rebate profiles 6*b* cut into the edges of the surrounding rails, stiles and mullions when these components are assembled together in a finished door as shown in FIG. 1D. In this preferred embodiment the raised panel is a curved moulding located at the transition point between the full panel thickness and the fielding profile to form a decorative border. However, in the practice of this invention, other decorative designs would also be acceptable for a border, as well as would having no border at all. Any type of shaping machine or combination of machines capable of cutting a desired transition moulding and fielding or other suitable type of bevel profile into the edges of the panels may be used in the practice of this invention. For example, a spindle moulder or overhead router may be used. In this preferred embodiment, a "CASOLIN" F-90 spindle moulder is typically utilized.

Assembly of Door-half Components

After door components of the present invention have been fabricated, they are assembled into a door. This assembly may be accomplished in a variety of ways. In one preferred embodiment, the separate door-halves are first formed from the individual components and then assembled and secured together on a jig table using pneumatic rams. Prior to assembly on the jig table, adhesive is applied to the mating surfaces of the sticking and coping profiles of each door component. In this embodiment adhesive is typically applied to female coping profiles only. Acceptable adhesives for use in the practice of this invention include any suitable type of glue such as, for example, white glues, epoxies, rubber cements, or cyanoacrylics. Typically, white waterproof wood glue is used. The adhesives may be applied using any acceptable method such as by brush or squeeze application. In one preferred embodiment, "MULTIBOND 2000" wood glue (available from Franklin International of Columbus, Ohio) is used. In this preferred embodiment, a "SCHNEEBERGER" glue applicator with a nozzle type tip is used to apply the glue. Although the glue application rate may vary, in this preferred embodiment, the glue is typically applied to the mating surfaces of the door components so that glue visibly coats substantially all areas of a coping profile.

In a preferred embodiment of the method of this invention, the stiles, rails and mullions for each door-half are laid out as illustrated in FIG. 1A. These door-half components are oriented so that the male sticking profiles and female coping profiles of each component mate and fit together in a tight manner at the joining points. In this embodiment, reusable jig panels are employed to properly align the door-half components of each door-half. These jig panels may be pieces of MDF cut to create panel spaces of the correct appropriate dimensions between the various door components. In this embodiment the edges of these jig panels have no fielding profile and are flat, with only their outside dimensions being related to the assembly process. In this embodiment, adhesive is typically applied to the female profile of rails, stiles and mullions (if used) of each door-half, these components being then assembled around the jig panels on the jig table. The components are then compressed to fit together with pneumatic rams that are distributed around at least a portion of the table. Typically, a jig table has pneumatic rams disposed on two adjacent sides of a table (one short side and one long side), and has stationary metal plates (for example, formed by two steel plates oriented at right angles) fixed to the two opposing sides of the table. The rams apply a compression force to the door-half components substantially parallel to the plane of the door. Once the door-half components have been compressed together around the jig panels on the pneumatic jig table, the joints of the assembled door-half may be stapled to temporarily secure the door components together while the adhesive sets. The staples are typically applied at all joining locations where the sticking and coping profiles of the door-half components mate together. For this purpose, any suitable staples and stapling means may be employed. In the preferred embodiment, ¼" wood staples (available from "PASLOAD") are applied using a "PASLOAD" 3200-S16 pneumatic staple gun. In this embodiment, an application density sufficient to secure the door components while the adhesive sets is typically used. The assembled door-half is then taken from the jig table, the jig panels removed, and the assembled door-half set aside for later assembly. In this embodiment, this portion of the assembly process completes the first door-half to be used to create a finished door. The process is repeated for the second door-half required to complete the door.

Assembly of Door-halves and Panels

In a preferred embodiment of the method of this invention, the next step is to assemble and secure the door-halves around the MDF panels. In this embodiment, a first door-half is placed on a suitable table or platform surface with the molding side of the sticking profiles facing downward and the rebate side of the sticking profiles facing upward. The upward facing exposed surfaces of the first door-half are then coated with an adhesive. In this preferred embodiment, the same type of glue used in the door-half assembly process previously described is used. In this step, the glue may be applied to the door-half in many acceptable ways. Thus, the glue may be brushed, sprayed, or rolled. In a preferred embodiment, the glue is typically applied with a "GUPFO" manual glue spreader having a glue reservoir using a 6" sponge roller. The glue may be applied in any amount sufficient to hold the door-halves and panels together. Typically, sufficient glue is used to visibly cover substantially all of the surface of the face of one door-half to be assembled.

Once the upward facing side of a first door-half is coated with adhesive, the appropriate door panels are placed on top of the first door-half and oriented in a manner so that the fielding profile cut into the panel perimeter edges mates with the recess or mortise formed by the rebate edges of the sticking profile cut into the edges of the stiles, rails and mullions of the door, as shown in FIGS. 1A and 1D. A second door-half, which is typically a "mirror image" of the first door-half, is then positioned on top of the first door-half in a manner corresponding to the orientation of first door-half so that it lines with the first door-half and panels. In this position, the rebate edge of the sticking profile of the second door-half is positioned so that it faces downward. As shown in FIG. 1A, the second door-half is oriented so that it is aligned with the adhesive-coated first door-half, and brought into contact with the first door-half in such a way that the rebate sides of the sticking profile of the stiles, rails and mullions of the second door-half mate with the fielding profile of the panel edges. For structural integrity and quality appearance, it is typical that the panel fielding profile fit tightly into the space formed between the rebate sides of the sticking profiles of the two assembled door-halves.

In a preferred embodiment, the entire door assembly just described is then compressed, so that the door-halves are pressed around the panels until the adhesive has dried. Acceptable means for compressing the door-halves together include any suitable pressing means, such as a "BLACK BROTHERS", "CASOLIN", or other suitable press, typically one capable of supplying at least about 2000 psi of compression. In one preferred embodiment, a hydraulic press is used, such as a "CASOLIN" T-80 hydraulic press. In such a press, up to about twelve 1⅜" doors or about ten 1¾" doors of the same design and size are typically stacked on top of each other and pressed together simultaneously. In this embodiment, the hydraulic press is operated so as to apply pressure, typically about 2000 psi, to the assembled doors. The doors are left under pressure for a length of time sufficient to allow the adhesive to set or cure. Using the glue of the preferred embodiment, this period of time is typically from about 2 to about 4 hours, depending on the temperature and humidity (which affects curing time of the glue). Although a pressure of about 2000 psi is most typically applied to the assembled doors, any pressure suitable for pressing door-halves around panels may be employed. Preferably, sufficient pressure is applied so that glue is squeezed out between the joints of the assembled door-halves to saturate the joining surfaces of the MDF door-halves with glue, while at the same time serving to eliminate any void spaces between the joined surfaces of the door-halves.

Trimming and Finishing Assembled Doors

Although unnecessary to practice the method of this invention, in one preferred embodiment the assembled door is typically sanded prior to trimming. Acceptable methods for sanding the MDF doors of this invention include manual sanding, rotary sanding, belt sanding, and drum sanding. In a preferred embodiment, a "CEMCO" single-headed upper and lower belt sander is typically employed.

In a preferred embodiment of this invention, the assembled door is trimmed to the desired width and height following compression. Trimming of the assembled door may be accomplished using any acceptable planing or sawing machine, or combinations thereof. Examples of such machines include a table saw, double end tenoner, and a double cross cut saw. In a preferred embodiment, a "GABBIANI" M-48 Double End Tenoner is used to trim the width of an assembled door by removing material from the outer side edges of the door. In this preferred embodiment, a "ROCKWELL INVICTA" Double Cross Cut Saw is used to trim the height of an assembled door by removing material from the end edges of the door. Following sanding and trimming, assembled doors may be painted or stained. As another finishing alternative, a thin laminate of wood or veneer may be applied to the exterior surfaces of the door.

Special and Decorative Door Embodiments

Figure 4:
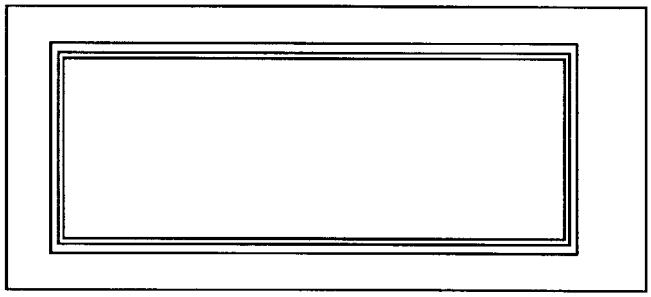
FIG. 4 is an illustration of one embodiment of a one panel door of this invention.
Figure 5:
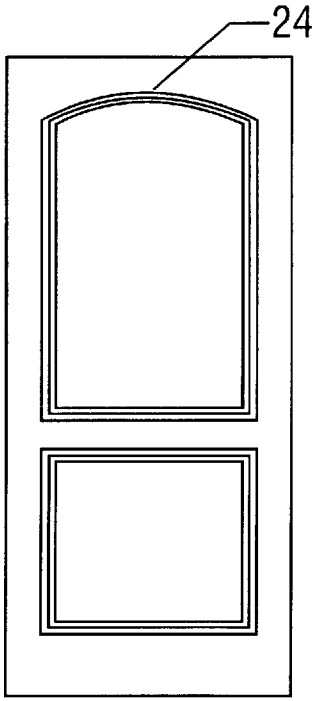
FIG. 5 is an illustration of one embodiment of a decorative two panel door of this invention.

In addition to doors having square panels and built in standard sizes, the method of the present invention may be advantageously used to manufacture doors of non-standard sizes, as well as doors having special decorative embellishments. Typically, raised mouldings of various designs may be applied to assembled doors by gluing and/or nailing. In FIGS. 3, 4 and 5, a number of preferred embodiments of the MDF door of the present invention designed for interior use are illustrated. These embodiments represent some of the possible door configurations that may be constructed using the method of the present invention. Door configurations may range from a basic one panel door having two stiles and top and bottom rails as shown in FIG. 4, to a decorative two panel door having a rounded top rail and an internal lock rail as shown in FIG. 5.

Figure 6:
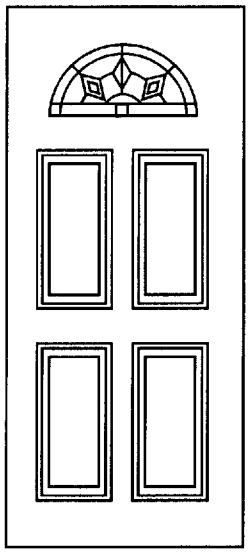
FIG. 6 is an illustration of one embodiment of a decorative panel door of this invention having a semi-circular glass panel.

Glass is one of many materials that may take the place of MDF in the construction of door panels in the practice of the present invention. In addition, panels may be circular, semi-circular, oval or cut in other non-rectangular and decorative shapes, as shown, for example, in FIG. 6. Besides glass, other panel materials that may be used in the practice of this invention include plastics, metals, woods, fiberboard or particleboard. Panels may also be removable or comprise hinged segments that may be selectively opened or closed. In addition, doors having vacant or empty openings with no panels may also be constructed using the disclosed method. In addition, door-half components (rails, mullions, and stiles) of the present invention may be cut in decorative, non-rectangular shapes. Door embodiments depicted in FIGS. 1–6 may be designed for use in interior and/or exterior applications.

The method of the present invention may be used to construct MDF door embodiments having standard widths ranging from about 1'4" to about 3' and standard heights ranging from about 6'8" to about 8'. These are standard widths and heights known to the building industry. However, in addition to these standard widths and heights, the method of this invention may be used to create MDF doors in non-standard widths and heights to meet varieties of decorative and dimensional requirements.

The method of the present invention may also be used to construct MDF door embodiments having standard door thicknesses of about 1⅜" and about 1¾", and having standard panel thicknesses of about ⅞" and 1¼", respectively. However, in addition to these standard thicknesses, the method of the present invention may be used to create doors of other thicknesses desired to meet the specifications of particular custom installations.

Some embodiments of the present invention that may be used to construct MDF doors having special and decorative characteristics are similar to the method described above for rectangular MDF panel doors. However, in some cases a few additional steps may be required to create decorative, non-rectangular shapes and designs. For example, in one possible embodiment that may be used to construct a decorative MDF panel door having curved rails, a special jig may be employed. MDF rail pieces described above may be shaped to any desired design. For example, in FIG. 5 the inner side of top rail 24 is curved. In one method for achieving such a shape or design, a shape may be transferred from a template to a rail or mullion and then cut on a band saw. The rail or mullion piece may then be placed into a MDF or plywood jig and the shape may be finished out on a "CASOLIN" shaper or overhead router. The curve may be finished out on a mill machine having a blade that imparts a decorative molded edge to the curve as it is cut. Examples of such mill machines include a spindle moulder or overhead router. Typically, a "CASOLIN" F-90 spindle shaper is used. Using this method, the curve is cut by pushing the rail against the curved edge of the master guide or jig, so that the blade of the special mill machine follows the curve of the master guide or jig. This technique may be applied to any rail or mullion piece within a door to create a desired design. In the practice of the method of this invention, the use of a master guide or jig in combination with a band saw and special mill machine is just one acceptable method of creating a decorative MDF panel door design. Other combinations of sawing or cutting means may be employed to impart decorative designs to the door-half components of this invention. Examples of other acceptable means include an overhead or "CNC" router.

Although the present invention has been described by reference to preferred embodiments, including methods for constructing doors that comprise certain steps completed in a certain order, it is not intended that the novel methods, compositions or structures of this invention be limited thereby, but various modifications are intended to be included as falling within the spirit and broad scope of the foregoing disclosure and the following claims. For example, it will be understood by those skilled in the art that the benefits of the present invention may also be achieved by using other types of fiberboard, such as low density fiberboard and high density fiberboard.

What is claimed is:

1. A method of making a door, comprising:

providing a first set of door-half components consisting essentially of fiberboard, said set comprising a plurality of vertical frame components and a plurality of horizontal frame components;

providing a second set of door-half components consisting essentially of fiberboard, said set comprising a plurality of vertical frame components and a plurality of horizontal frame components;

first, assembling the first set of door-half components to form a first door-half, and assembling the second set of door-half components to form a second door-half; and then assembling the first and second door-halves together.

2. The method of claim 1 wherein the step of assembling the first and second door-halves together comprises the steps of:

providing at least one panel;

first positioning the panel between the first and second door-halves; and then assembling the first and second door-halves together so that said assembled door-halves make contact with the panel.

3. The method of claim 1 wherein the door-half components are composed of substantially medium density fiberboard.

4. The method of claim 2 wherein at least one panel is composed of substantially medium density fiberboard.

5. A method of making a door, comprising:

providing first and second pairs of stiles composed substantially of medium density fiberboard;

providing first and second pairs of outer rails composed substantially of medium density fiberboard; wherein the first pair of outer rails is comprised of a first bottom rail and a first top rail; and wherein the second pair of outer rails is comprised of a second bottom rail and a second top rail;

providing at least one panel;

first assembling the first pair of stiles, the first bottom rail, and the first top rail to form a first frame, the first frame comprising a first door half, and assembling the second pair of stiles, the second bottom rail, and the second top rail to form a second frame, the second frame comprising a second door-half;

then positioning at least one panel between the first and second door-halves; and then assembling the first and second door-halves together to form said door by bringing the first frame and the second frame together so as to form a substantially continuous laminate and to sandwich said panel between said first and second frames.

6. The method of claim 5, further comprising the steps of:

providing a plurality of intermediate rails composed substantially of medium density fiberboard, including at least one first intermediate rail and at least one second intermediate rail;

wherein the step of assembling the first pair of stiles, the first bottom rail, and the first top rail to form a first frame further comprises assembling at least one first intermediate rail with the first pair of stiles and the first pair of outer rails to form the first door-half; and wherein the step of assembling the second pair of stiles, the second bottom rail, and the second top rail to form a second frame further comprises assembling at least one second intermediate rail with the second pair of stiles and the second pair of outer rails to form the second door-half.

7. The method of claim 5, further comprising the steps of:

providing a plurality of mullions composed substantially of medium density fiberboard, including at least one first mullion and at least one second mullion;

wherein the step of assembling the first pair of stiles, the first bottom rail, and the first top rail to form a first frame further comprises assembling at least one first mullion with the first pair of stiles and, the first pair of outer rails to form the first door-half; and wherein the step of assembling the second pair of stiles, the second bottom rail, and the second top rail to form a second frame further comprises assembling at least one second mullion with the second pair of stiles and, the second pair of outer rails to form the second door-half.

8. The method of claim 5, wherein the step of assembling the first pair of stiles, the first bottom rail, and the first top rail to form a first door-half comprises the step of:

securing the first pair of outer rails to the pair of stiles with adhesive;

and wherein the step of assembling the second pair of stiles, the second bottom rail, and the second top rail to form a second door-half comprises the step of securing the second pair of outer rails to the second pair of stiles with adhesive.

9. The method of claim 5, wherein the step of assembling each door-half comprises the steps of:

first placing the respective pairs of stiles and the respective pairs of outer rails into a jig; and then applying pressure substantially parallel to the plane of the door-half being assembled.

10. The method of claim 5, wherein the step of assembling the first and second door-halves together comprises the step of securing the first door-half to the second door-half with adhesive.

11. The method of claim 10, wherein the step of securing the first door-half to the second door-half with adhesive comprises the step of applying pressure substantially perpendicular to the plane of the assembled door-halves.

12. The method of claim 5, further comprising:

performing the following steps prior to assembling the respective first and second pairs of stiles, the respective first and second bottom rails, and the respective first and second top rails to form the respective first and second frames:

machining a coping profile into the end edges of each outer rail, machining a sticking profile into the top edge of each bottom rail, machining a sticking profile into the bottom edge of each top rail, and machining a sticking profile into one side edge of each stile, wherein said sticking profile is shaped to fit tightly into the coping profile machined into the end edges of each outer rail when the outer rails and stiles are assembled to form the first and second frames; and performing the following step prior to assembling the first and second door-halves together to form said door:

machining a fielding profile into the perimeter edges of at least one panel, wherein said fielding profile is shaped to fit tightly between the sticking profiles machined into the side edges of each stile and the top and bottom edges of each outer rail when the first and second frames are assembled together to sandwich the panel and form a substantially continuous laminate.

13. A method of making a door, comprising:

providing first and second pairs of fiberboard stiles, wherein each stile has an interior side edge with a sticking profile;

providing first and second pairs of fiberboard outer rails, wherein the first pair of outer rails is comprised of a first bottom rail and a first top rail, wherein the second pair of outer rails is comprised of a second bottom rail and a second top rail, wherein each top rail has two end edges, a top edge and a bottom edge, wherein each bottom rail has two end edges, a top edge and a bottom edge, wherein each end edge of each top and bottom rail has a coping profile, and wherein the bottom edge of each top rail and the top edge of each bottom rail has a sticking profile;

providing at least two fiberboard intermediate rails including at least one first intermediate rail and at least one second intermediate rail, wherein each intermediate rail has two end edges and two side edges, wherein each end edge of each intermediate rail has a coping profile, and wherein each side edge of each intermediate rail has a sticking profile;

providing at least two fiberboard mullions including at least one first mullion and at least one second mullion, wherein each mullion has two end edges and two side edges, wherein each end edge of each mullion has a coping profile, and wherein each side edge of each mullion has a sticking profile;

providing at least one panel, wherein the panel has a perimeter edge with a fielding profile;

first, assembling first and second door halves by:

assembling the first pair of stiles, the first pair of outer rails, at least one first intermediate rail, and at least one first mullion to form a first door-half, then applying adhesive to at least a portion of the assembled stiles, rails or mullion of the first door-half, then applying pressure substantially parallel to the plane of the first door-half assembly, then applying staples to at least a portion of the stiles, rails or mullion of the first door-half, and assembling the second pair of stiles, the second pair of outer rails, at least one second intermediate rail, and at least one second mullion to form a second door-half, then applying adhesive to at least a portion of the assembled stiles, rails or mullion of the second door-half, then applying pressure substantially parallel to the plane of the second door-half assembly, then applying staples to at least a portion of the stiles, rails or mullion of the second door-half;

next positioning at least one panel between the first and second door-halves;

next applying adhesive to at least a portion of the surface of at least one door-half;

next assembling the first and second door-halves together by bringing the first door-half in contact with the second door-half with the adhesive therebetween; and next applying pressure substantially perpendicular to the plane of the assembled door-halves while the adhesive sets.

14. The method of claim 13, wherein the stiles, rails, mullions and panels are comprised of substantially medium density fiberboard.

* * * * *